US008089220B2

(12) United States Patent
Braun et al.

(10) Patent No.: US 8,089,220 B2
(45) Date of Patent: Jan. 3, 2012

(54) CIRCUIT ARRANGEMENT AND METHOD FOR OPERATING A HIGH-PRESSURE DISCHARGE LAMP

(75) Inventors: Alois Braun, Neuburg (DE); Walter Limmer, München (DE); Joachim Mühlschlegel, Gröbenzell (DE)

(73) Assignee: Osram AG, Munich (DE)

( * ) Notice: Subject to any disclaimer, the term of this patent is extended or adjusted under 35 U.S.C. 154(b) by 589 days.

(21) Appl. No.: 12/223,918

(22) PCT Filed: Feb. 8, 2007

(86) PCT No.: PCT/EP2007/051230

§ 371 (c)(1),
(2), (4) Date: Aug. 13, 2008

(87) PCT Pub. No.: WO2007/096253

PCT Pub. Date: Aug. 30, 2007

(65) Prior Publication Data

US 2009/0295302 A1 Dec. 3, 2009

(30) Foreign Application Priority Data

Feb. 20, 2006 (DE) ..... 10 2006 007 754

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 39/02* | (2006.01) |
| *H05B 37/00* | (2006.01) |
| *H05B 39/00* | (2006.01) |
| *H05B 41/00* | (2006.01) |
| *H01J 11/04* | (2006.01) |
| *H01J 13/48* | (2006.01) |
| *H01J 15/04* | (2006.01) |
| *H01J 17/36* | (2006.01) |

(52) U.S. Cl. ..... 315/307; 315/209 R; 315/225; 315/226; 315/291; 315/326; 315/DIG. 7

(58) Field of Classification Search ..... None
See application file for complete search history.

(56) References Cited

U.S. PATENT DOCUMENTS

| | | | | |
|---|---|---|---|---|
| 5,083,065 | A * | 1/1992 | Sakata et al. | 315/307 |
| 6,437,515 | B1 * | 8/2002 | Kamoi et al. | 315/209 R |

FOREIGN PATENT DOCUMENTS

| | | | |
|---|---|---|---|
| DE | 199 17 180 | A1 | 10/1999 |
| DE | 100 25 610 | A1 | 7/2001 |
| WO | 99/05889 | A | 2/1999 |

* cited by examiner

*Primary Examiner* — Douglas W Owens
*Assistant Examiner* — Dedei K Hammond

(57) ABSTRACT

A circuit arrangement for operating a high pressure discharge lamp includes a bridge circuit with at least two switches, a control device controlling the switches. The bridge circuit is a half-bridge circuit having exactly two switches. The control device switches on and off in an alternating manner, the first switch and the second switch of the bridge circuit having a first frequency. When the first switch is switched off for controlling the other switch with a rectangular signal of a second frequency which is greater than the first frequency and a predeterminable connection duration. The circuit also includes a tension measuring device measuring an actual value of tension over the high pressure discharge lamp. A reference device provides at least one upper threshold value for the voltage via the high pressure discharge lamp. A comparison device compares the actual voltage over the high pressure discharge lamp with the threshold value.

15 Claims, 2 Drawing Sheets

CIRCUIT ARRANGEMENT AND METHOD FOR OPERATING A HIGH-PRESSURE DISCHARGE LAMP

TECHNICAL FIELD

The present invention relates to a circuit arrangement for operating a high-pressure discharge lamp comprising a bridge circuit with at least two switches and a control apparatus, which is designed to drive the at least two switches. The invention moreover relates to an operating method for a high-pressure discharge lamp using a circuit arrangement comprising a half-bridge circuit with precisely two switches, a control apparatus, which alternately switches the first switch and the second switch in the half-bridge circuit on and off at a first frequency and, during the off phase of the one switch, drives the other switch with a square-wave signal of a second frequency, which is higher than the first frequency, and a predeterminable switch-on duration.

PRIOR ART

In general, the present invention relates to the problem of extinguishing high-pressure discharge lamps. Generally, high-pressure discharge lamps are operated using a full-bridge circuit, i.e. using a bridge circuit with four switches. With a view to reducing costs, it is desirable to operate high-pressure discharge lamps using a half-bridge circuit. As has been proven in practice, however, this results in the high-pressure discharge lamp being extinguished within a short period of time in the case of many types of high-pressure discharge lamps.

DESCRIPTION OF THE INVENTION

The object of the present invention therefore consists in developing the circuit arrangement mentioned at the outset or the operating method mentioned at the outset in such a way that the operation of as many types of high-pressure discharge lamp as possible is enabled even using a half-bridge circuit.

This object is achieved by a circuit arrangement having the features of patent claim 1 and by an operating method having the features of patent claim 14.

The present invention is based on the knowledge that a half-bridge circuit is less "rigid" than a full-bridge circuit, i.e. has fewer voltage reserves (excessively low off-load voltage). In order to explain the consequences resulting from this, FIG. 1 shows the time profile of the so-called intermediate circuit voltage $U_{ZW}$ which is present at the half-bridge circuit, and the time profile of the current $I_L$ through the lamp and the voltage $U_L$ across the lamp. The zero line for the voltage $U_L$ is identified by "4", while the zero line for the current $I_L$ is denoted by "3". In this case, a control apparatus has been used which alternately switches the first and the second switches in the half-bridge circuit on and off at a first frequency and, during the off phase of the one switch, drives the other switch with a square-wave signal of a second frequency, which is higher than the first frequency, and a predeterminable switch-on duration. In the exemplary embodiment in FIG. 1, the first frequency is 160 Hz, while the second frequency is 90 kHz. The switch-on duration of the square-wave signal of the second frequency is constant and is approximately 6 μs.

The analysis of FIG. 1 provides the following result: Owing to the real converter output characteristic, which is flatter in the case of a half-bridge circuit than in the case of a full-bridge circuit, the running voltage of the high-pressure discharge lamp after commutation increases as a result of the extremely nonlinear load which is represented by a high-pressure discharge lamp. The lamp current $I_L$ only increases after commutation to approximately half the rated value and then, owing to plasma cooling and the resultant further increase in the running voltage, is reduced to zero.

During operation various approaches have been tested to see how this problem can be counteracted:

First, a power regulator was considered which regulates the power converted in the high-pressure discharge lamp to its desired value. Such power regulators are in principle slow ($\tau$ approximately 100 ms), however, and cannot counteract the event of the high-pressure discharge lamp suddenly becoming highly resistive anywhere near quickly enough (see FIG. 1; $\tau$ approximately 4 ms).

Regulation of the lamp voltage $U_L$ would go beyond keeping the voltage constant. That is to say an increase in the running voltage would have to be counteracted by the running voltage being reduced in terms of its amplitude. This would result in particular in a reduction in the lamp current and consequently accelerate extinguishing of the lamp instead of preventing it.

A measurement of the lamp current $I_L$ is possible with reasonable complexity in a half-bridge circuit only in one direction with respect to the first frequency. In the other direction, the monitoring would therefore be "blind" and could not counteract the increase in running voltage occurring during such a cycle. A measurement of the lamp current in both flow directions continuously or with a high sampling rate results in an undesirably high complexity primarily when, as in the exemplary embodiment, the first frequency is comparatively low.

There is another approach for the invention: first, it is based on the knowledge that an increase in the running voltage must be counteracted by an increase in the lamp current. An increase in the running voltage can be established in a simple manner by a voltage measurement apparatus. This can be realized without excessive complexity for both directions of the first frequency. It is furthermore based on allowing the first frequency to be substantially constant, and for this purpose extending the switch-on duration of the signal with which the one switch in the half-bridge circuit is driven during the off phase of the other switch, at least for a predeterminable period of time. As a result, an increase in the lamp current can be brought about which, together with the increase in the running voltage of the lamp, results in a power converted in the lamp which is sufficient for preventing cooling of the plasma, which would result in extinguishing of the lamp.

The surprising fact in relation to the solution according to the invention is the fact that actually an extension of the switch-on duration of the second frequency must result in a further increase in the running voltage of the lamp. In practice, however, this is surprisingly not the case as a result of the nonlinearity of the high-pressure discharge lamp. Instead, an extension of the switch-on duration results in an increase in the lamp current, therefore in heating of the plasma and therefore in a reduction in the running voltage.

In a preferred embodiment, in addition to the extension of the switch-on duration, the second frequency is reduced. This provides the advantage that the half-bridge switches switch on when the current in the lamp inductor is equal to zero. As a result, the switching losses in the half-bridge switches are reduced.

In preferred embodiments, the second frequency is at least 15 kHz, while the first frequency is a maximum of 500 Hz.

Preferably, the predeterminable period of time for the extension of the switch-on duration is at least 30 μs, in particular at least 100 μs, and at most 3 ms, in particular at most 500 μs.

In a particularly preferred development, the voltage measurement apparatus, the reference value apparatus, the comparison apparatus and the control apparatus are dimensioned in such a way that the period of time between the actual event of the at least one limit value being exceeded and the driving of the two switches in the half-bridge circuit at the extended switched-on duration is a maximum of 1 ms, in particular a maximum of 0.3 ms.

The at least one limit value may be a constant limit value, but may also be a limit value which is dependent on the mean voltage across the high-pressure discharge lamp. The last mentioned implementation takes account of an ageing-related shift in the rated running voltage and makes it possible to identify a discrepancy independently of the life of the high-pressure discharge lamp. Preferably, the mean voltage of the high-pressure discharge lamp is updated at equidistant intervals, for example every 50 to 100 ms.

Particularly preferably, the control apparatus is designed to dimension the extension of the switch-on duration as a function of the measured voltage across the high-pressure discharge lamp and/or of the temporal mean of the voltage across the high-pressure discharge lamp and/or of the critical limit value.

The control apparatus can in addition be designed to ignore an event of the limit value being exceeded by the voltage measured across the high-pressure discharge lamp after commutation of the current through the high-pressure discharge lamp for a predeterminable period of time, in particular for at least 10 μs. This ensures that the lamp voltage is only evaluated after the ignoring period, i.e. after the overshoot of the lamp voltage which is brought about by the commutation. This overshoot should be distinguished from the undesirable increase in the running voltage, which is made possible as a result of the fact that it is temporally limited.

Preferred embodiments of the circuit arrangement according to the invention are characterized by the fact that, after an extension of the switch-on duration for the predeterminable period of time, the switch-on duration is reduced stepwise or continuously to the initial value again. In this case, a plurality of intermediate stages can be provided, an undershoot in the lamp current can be reliably avoided by this measure.

In contrast, the control apparatus can also be designed to extend the switch-on duration stepwise or continuously.

Further advantageous embodiments are given in the dependent claims.

The preferred embodiments mentioned in connection with the circuit arrangement according to the invention and advantages thereof apply, insofar as they are applicable, correspondingly to the operating method according to the invention for a high-pressure discharge lamp.

BRIEF DESCRIPTION OF THE DRAWING(S)

An exemplary embodiment of a circuit arrangement according to the invention will now be explained in more detail below with reference to the attached drawings, in which.

PREFERRED EMBODIMENT OF THE INVENTION

Figure 1:
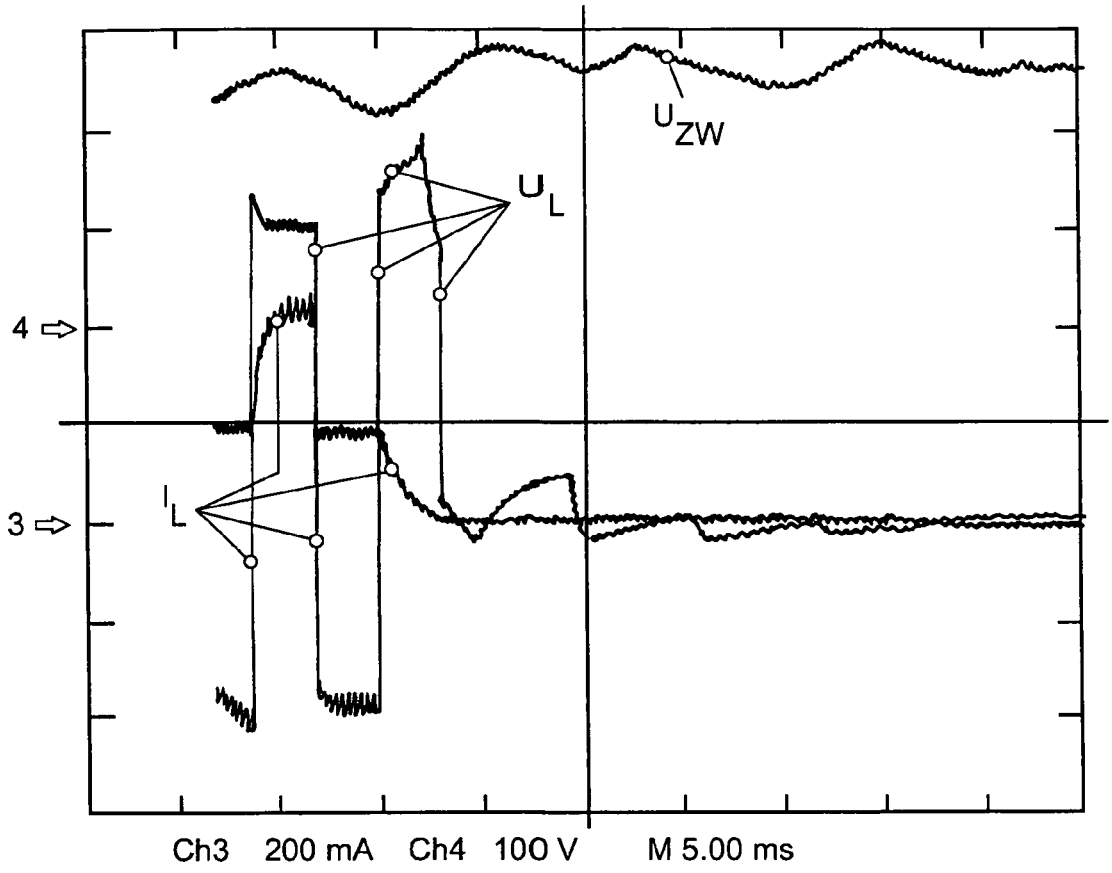
FIG. 1 shows the time profile in particular of the lamp voltage $U_L$ of a high-pressure discharge lamp and of the lamp current $I_L$ without any inventive measures.
Figure 2:
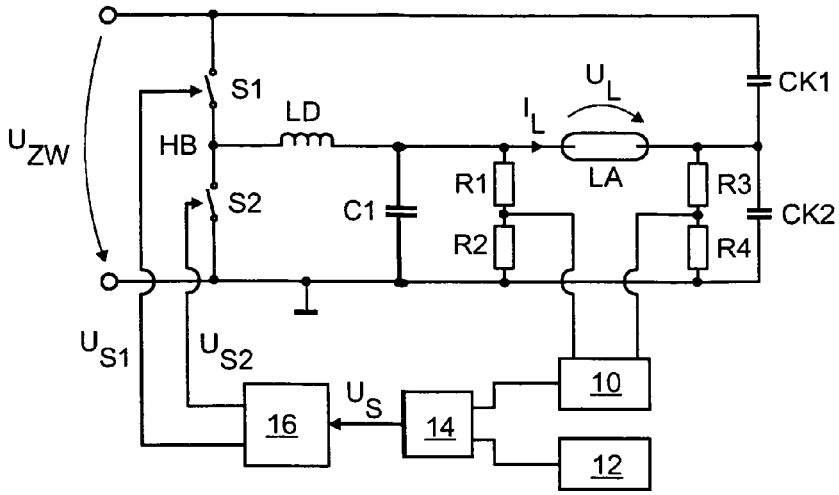
FIG. 2 shows a schematic illustration of the design of a circuit arrangement according to the invention.
Figure 3:
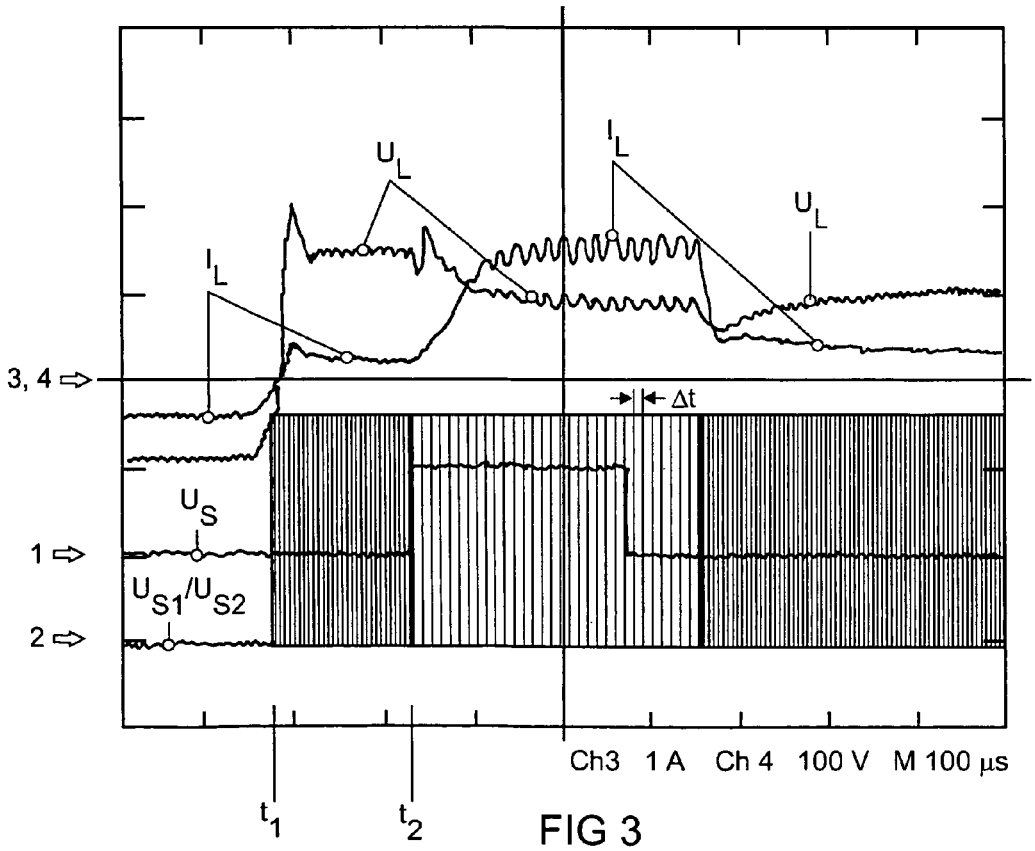
FIG. 3 shows the time profile in particular of the lamp voltage $U_L$ and of the lamp current $I_L$ in the case of a circuit arrangement according to the invention as shown in FIG. 2.

The variables introduced in respect of FIG. 1 and their reference symbols, insofar as identical and similar variables are affected, are also used in FIGS. 2 and 3.

FIG. 2 shows a schematic illustration of the design of an exemplary embodiment of a circuit arrangement according to the invention. In this case, the so-called intermediate circuit voltage $U_{ZW}$ is present at the two switches S1, S2 in the half-bridge arrangement. Depending on the embodiment, this voltage amounts to approximately 200 to 500 V and is generally produced from the mains voltage via a rectifier and a smoothing capacitor. The half-bridge centerpoint HB is connected to a first terminal of the lamp LA via a lamp inductor $L_D$. Moreover, a capacitor $C_1$, which is designed, together with the lamp inductor $L_D$, to start the lamp LA, is connected to this terminal. The current flowing through the lamp is denoted by $I_L$, and the voltage dropping across the lamp by $U_L$. The other terminal of the lamp LA is firstly connected to the intermediate circuit voltage $U_{ZW}$ via a coupling capacitor $C_{K1}$, and secondly to a reference potential, in this case ground, via a coupling capacitor $C_{K2}$. The first lamp terminal is connected to the reference potential via a first voltage divider comprising the resistors R1 and R2, and the second terminal of the lamp LA is connected to the reference potential via a second voltage divider comprising the resistors R3 and R4. The respective taps of the two voltage dividers are connected to a voltage measurement apparatus 10 for measuring the actual value of the voltage $U_L$ across the high-pressure discharge lamp LA so as to determine a voltage which is correlated with the lamp voltage $U_L$. A reference value apparatus 12 provides at least one upper limit value for the voltage $U_L$ across the high-pressure discharge lamp LA to a comparison apparatus 14. The comparison apparatus 14 is designed to compare the actual value of the voltage $U_L$ across the high-pressure discharge lamp LA, which is provided by the voltage measurement apparatus 10, with the at least one upper limit value for the voltage $U_L$ across the high-pressure discharge lamp LA, which is provided by the reference value apparatus 12.

The circuit arrangement shown in FIG. 2 furthermore comprises a control apparatus 16, which is designed to alternately switch the first switch S1 and the second switch S2 in the bridge circuit on and off at a first frequency and, during the off phase of the one switch S1, S2, to drive the other switch S2, S1 with a square-wave signal of a second frequency, which is higher than the first frequency, and a predeterminable switch-on duration. If the comparison apparatus now establishes that the actual value of the voltage $U_L$ across the high-pressure discharge lamp LA, in particular in terms of its absolute value, is above the at least one limit value, it drives the control apparatus 16 in such a way that the latter extends the predeterminable switch-on duration of the signal with which the one switch S1, S2 in the half-bridge circuit is driven during the off phase of the other switch S2, S1, at least for a predeterminable period of time. This extension of the switch-on duration results in an increase in the current $I_L$ through the high-pressure discharge lamp LA.

FIG. 3 shows the time profile of different variables, but with reference being made to the fact that, in comparison with the illustration in FIG. 1, the illustration in FIG. 3 is enlarged by a factor of 10. The zero lines for the lamp voltage $U_L$ and the lamp current $I_L$ coincide and correspond to the central line in the illustration, as can be seen on the left by the overlap of a 3 and a 4. After commutation, i.e. after the time $t_1$, the lamp voltage $U_L$ is increased as a result of the nonlinear characteristic of the high-pressure discharge lamp LA. As a result, the lamp current $I_L$ remains noticeably below its rated value, in this case 0.4 A. As a result, the lamp will operate with at too low a power and the plasma will begin to cool. The comparison apparatus 14 (see FIG. 2) identifies an event of the limit value for the lamp voltage $U_L$ being exceeded and thereupon extends the switch-on duration Δt of the signal with which the one switch in the half-bridge circuit is driven during the off phase of the other switch, at time $t_2$. At the same time, the second frequency is reduced by approximately 50%. The signal provided by the comparison apparatus 14 to the control apparatus 16 is denoted by $U_S$; see also FIG. 2. The signal applied to the respectively active switch S1, S2 by the control apparatus 16 is denoted by $U_{S1}/U_{S2}$. The predeterminable period of time for the extension of the switch-on duration At is in this case 300 μs. As a result of the extension of the switch-on duration Δt, the lamp current $I_L$ is increased noticeably to a value which is above the rated value. The running voltage $U_L$ of the high-pressure discharge lamp is reduced as a result of the increase in current to normal values. Once 300 μs have elapsed, the switch-on duration Δt is reduced again to the normal value, with the result that the lamp then continues to be operated at its rated current.

The invention claimed is:

1. A circuit arrangement for operating a high-pressure discharge lamp comprising:

a bridge circuit with at least two switches, a control apparatus, which is designed to drive the at least two switches;

wherein the bridge circuit is in the form of a half-bridge circuit with precisely two switches, the control apparatus being designed to alternately switch the first switch and the second switch in the bridge circuit on and off at a first frequency and, during the off phase of the one switch, to drive the other switch with a square-wave signal of a second frequency, which is higher than the first frequency, the circuit arrangement furthermore comprising:

a voltage measurement apparatus for measuring an actual value of the voltage across the high-pressure discharge lamp;

a reference value apparatus, which provides at least one upper limit value for the voltage across the high-pressure discharge lamp;

a comparison apparatus for comparing the actual value of the voltage across the high-pressure discharge lamp with the at least one limit value;

the comparison apparatus being designed in such a way that, in the case in which the actual value of the voltage across the high-pressure discharge lamp is above the at least one limit value, it drives the control apparatus in such a way that the control apparatus extends a predeterminable switch-on duration of the signal with which the one switch of the half-bridge circuit is driven during the off phase of the other switch, at least for a predeterminable period of time.

2. The circuit arrangement as claimed in claim 1, wherein the circuit arrangement is designed in such a way that the extension of the switch-on duration results in an increase in the current through the high-pressure discharge lamp.

3. The circuit arrangement as claimed in claim 1, wherein, in addition to the extension of the switch-on duration, the second frequency is reduced.

4. The circuit arrangement as claimed in claim 1, wherein the second frequency is at least 15 kHz.

5. The circuit arrangement as claimed in claim 1, wherein the first frequency is a maximum of 500 Hz.

6. The circuit arrangement as claimed in claim 1, wherein the period of time for the extension of the switch-on duration is at least 30 μs and at most 3 ms.

7. The circuit arrangement as claimed in claim 1, wherein the voltage measurement apparatus, the reference value apparatus, the comparison apparatus and the control apparatus are dimensioned in such a way that the period of time between the actual event of the at least one limit value being exceeded and the driving of the two switches in the half-bridge circuit at the extended switch-on duration is a maximum of 1 ms.

8. The circuit arrangement as claimed in claim 1, wherein the at least one limit value is a constant limit value.

9. The circuit arrangement as claimed in claim 1, wherein the at least one limit value is a limit value which is dependent on the mean voltage across the high-pressure discharge lamp.

10. The circuit arrangement as claimed in claim 1, wherein the control apparatus is designed to dimension the extension of the switch-on duration as a function of the measured voltage across the high-pressure discharge lamp (LA)-and/or of the temporal mean of the voltage across the high-pressure discharge lamp and/or of the critical limit value.

11. The circuit arrangement as claimed in claim 1, wherein the control apparatus is designed to ignore an event of the limit value being exceeded by the voltage measured across the high-pressure discharge lamp after commutation of the current through the high-pressure discharge lamp for a predeterminable period of time.

12. The circuit arrangement as claimed in claim 1, wherein the control apparatus is designed to reduce the switch-on duration stepwise or continuously to the initial value once the switch-on duration has been extended for the predeterminable period of time.

13. The circuit arrangement as claimed in claim 1, wherein the control apparatus is designed to extend the switch-on duration stepwise or continuously.

14. An operating method for a high-pressure discharge lamp using a circuit arrangement comprising a half-bridge circuit with precisely two switches, a control apparatus, which alternately switches the first switch and the second switch in the half-bridge circuit on and off at a first frequency and, during the off phase of the one switch, drives the other switch with a square-wave signal of a second frequency, which is higher than the first frequency, and comprising the following steps: a) measurement of an actual value of the voltage across the high-pressure discharge lamp; b) comparison of the actual value of the voltage across the high-pressure discharge lamp with the at least one upper limit value for the voltage across the high-pressure discharge lamp; c) in the case in which the actual value of the voltage across the high-pressure discharge lamp is above the at least one limit value: extending a switch-on duration of the signal with which the two switches in the half-bridge circuit are driven, at least for a predeterminable period of time.

15. The circuit arrangement as claimed in claim 2, wherein, in addition to the extension of the switch-on duration, the second frequency is reduced.

* * * * *

UNITED STATES PATENT AND TRADEMARK OFFICE

CERTIFICATE OF CORRECTION

PATENT NO. : 8,089,220 B2
APPLICATION NO. : 12/223918
DATED : January 3, 2012
INVENTOR(S) : Alois Braun et al.

It is certified that error appears in the above-identified patent and that said Letters Patent is hereby corrected as shown below:

Column 6, line 26 (Claim 10, line 4) please correct to read as follows:

"discharge lamp and/or of"

Signed and Sealed this
Fifth Day of June, 2012

David J. Kappos

David J. Kappos
*Director of the United States Patent and Trademark Office*